US005463448A

United States Patent [19]

Wilson et al.

[11] Patent Number: 5,463,448

[45] Date of Patent: Oct. 31, 1995

[54] REPRODUCTION APPARATUS HAVING MULTIPLE WAYS OF ENTERING AN INFORMATION SYSTEM

[75] Inventors: James Wilson, Coral Springs, Fla.; Frederick E. Altrieth, Scottsville, N.Y.

[73] Assignee: Eastman Kodak Company, Rochester, N.Y.

[21] Appl. No.: 229,892

[22] Filed: Apr. 19, 1994

[51] Int. Cl.[6] ..... G03G 21/00

[52] U.S. Cl. ..... 355/202; 355/200; 355/204; 355/209

[58] Field of Search ..... 355/200, 202, 355/204, 206, 208, 209, 210; 371/16.4; 364/146

[56] References Cited

U.S. PATENT DOCUMENTS

| | | | |
|---|---|---|---|
| 4,740,818 | 4/1988 | Tsilibes et al. . | |
| 5,010,551 | 4/1991 | Goldsmith et al. | 371/16.4 |
| 5,045,880 | 9/1991 | Evanitsky et al. | 355/200 |
| 5,049,929 | 9/1991 | Anderson et al. | 355/204 |
| 5,049,931 | 9/1991 | Knodt | 355/209 |
| 5,061,958 | 10/1991 | Bunker et al. | 355/209 |
| 5,105,220 | 4/1992 | Knodt et al. | 355/209 |
| 5,133,222 | 5/1992 | Wilson et al. | 355/209 |
| 5,243,380 | 9/1993 | Pesar et al. | 355/204 |
| 5,305,055 | 4/1994 | Ebner et al. | 355/200 |
| 5,343,275 | 8/1994 | Sulenski | 355/202 |

*Primary Examiner*—Sandra L. Brase
*Attorney, Agent, or Firm*—William F. Noval

[57] ABSTRACT

In reproduction apparatus having a plurality of selectable features for carrying out a reproduction run, and an operator control panel for providing operator interface for controlling the reproduction apparatus. The operator control panel provides multiple ways for entering an information system by either actuating a "hard" button or a "soft" button or area of a touchscreen display.

3 Claims, 9 Drawing Sheets

REPRODUCTION APPARATUS HAVING MULTIPLE WAYS OF ENTERING AN INFORMATION SYSTEM

FIELD OF THE INVENTION

The present invention relates, in general, to reproduction apparatus, and relates, more specifically, to electrographic reproduction apparatus having an information system provided with multiple ways for entering the information system.

BACKGROUND OF THE INVENTION

Electrographic reproduction apparatus are provided with an operator control panel for allowing an operator to program the apparatus for a reproduction run. In its simplest form, the control panel includes several dedicated (hard) buttons and switches for selecting features for a reproduction run, as well as visual indicators for informing the operator which features were selected. The operator control panel can also have a display for displaying messages. The control panel also includes keys and buttons for altering the display to indicate selected options. (See, for example, U.S. Pat. No. 5,113,222, issued May 12, 1992, to Wilson et al.) The display may also include a touchscreen overlay having "soft buttons" for providing operator input to the reproduction apparatus. (See, for example, U.S. Pat. No. 5,045,880, issued Sep. 3, 1991 to Evanitsky et al; U.S. Pat. No. 5,061,958, issued Oct. 29, 1991 to Bunker et al.; U.S. Pat. No. 5,105,220, issued Apr. 14, 1992 to Knodt et al.; U.S. Pat. No. 5,049,931, issued Sep. 17, 1991 to Knodt; and U.S. Pat. No. 5,010,551, issued Apr. 23, 1991 to Goldsmith et al.)

Because of the complexity and diversity of features of electrographic reproduction apparatus, it is difficult for an operator to possess all of the information needed to understand all of these features. Therefore, it is common to provide an information button to allow access by the operator to additional information about a feature stored in an information system of the reproduction apparatus, as discussed in the aforementioned patents. A problem arises, however, with the speed with which information about a specific feature is available. Typically, actuating the information button causes a main menu screen to appear on the display, and requires scanning through one or more feature screens before the desired information is displayed. Such scanning is both time-consuming and inefficient.

SUMMARY OF THE INVENTION

According to the present invention, there is provided a solution to the problems of the prior art by providing additional and more direct ways to access information about a feature of the reproduction apparatus.

According to a feature of the present invention, there is provided in a reproduction apparatus having a plurality of selectable features for carrying out a reproduction run, an operator control panel for providing operator interface for controlling said reproduction apparatus comprising:

a plurality of operator selectable "hard" buttons for providing input to and control of said reproduction apparatus;

a display for displaying selectable features for a reproduction run and for displaying messages;

a touchscreen overlaying at least a part of said display, having operator selectable "soft" buttons and areas for providing operator input to said reproduction apparatus; and an information system stored in said reproduction apparatus, said information system being accessible either by one of said plurality of operator selectable hard buttons or by an operator selectable soft button or area of said touchscreen.

DETAILED DESCRIPTION OF THE PREFERRED EMBODIMENTS

Because electrographic reproduction apparatus 1 are well-known, the present description will be directed, in particular, to elements forming part of or cooperating more directly with the present invention. Apparatus not specifically shown or described herein are selectable from those known in the prior art. Particular reference is made to U.S. Pat. No. 4,740,818 and U.S. Pat. No. 5,113,222, the contents of which are incorporated herein by reference.

Figure 1:
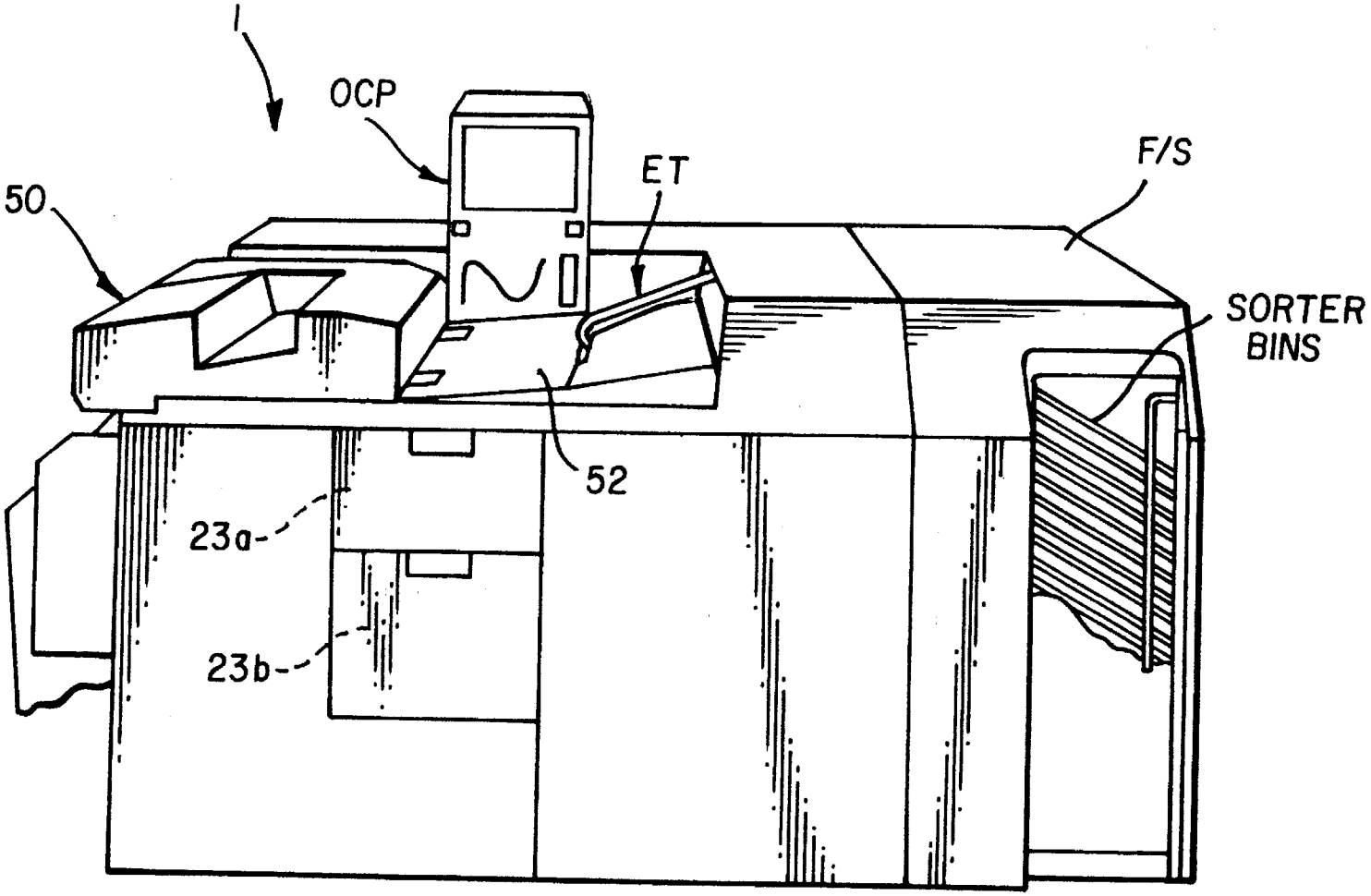
FIG. 1 is a front perspective view of an electrographic reproduction apparatus for incorporating the present invention.

With reference now to FIG. 1, there is shown an electrographic reproduction apparatus 1 having a recirculating document feeder 50 that includes a tray portion for accepting a multi-sheet document original for reproduction. The apparatus 1 includes an operator control panel (OCP) which, as will be described, includes buttons and prompting displays for facilitating a job setup, i.e., the input of an instruction set to the apparatus logic and control unit (LCU) to enable it to control a series of operations resulting in a desired copy output representing a reproduction of the document originals. Copies may be produced on receiver sheets stored in either or both drawers holding trays 23*a* and 23*b*. The copy output from the apparatus is stored either in an exit tray (ET) or finisher/sorter (F/S) having a series of sorter bins, as is well known.

Figure 2:
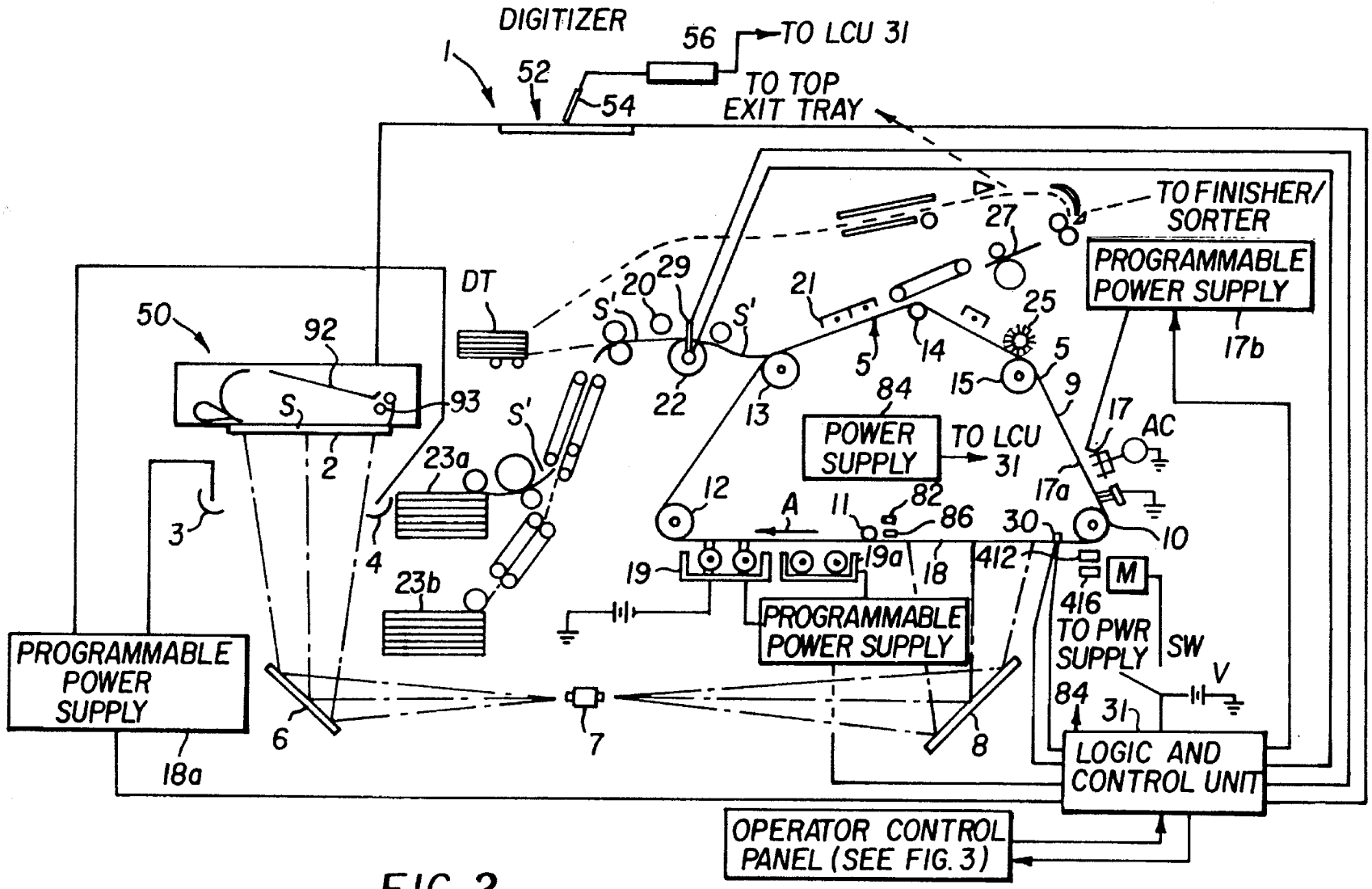
FIG. 2 is a schematic diagram of the electrographic reproduction apparatus of FIG. 1.

Referring now to FIG. 2, the electrographic reproduction apparatus of FIG. 1 incorporating the present invention will be described in greater detail. As shown, reproduction apparatus 1 includes a photoconductive web 5 that is trained about six transport rollers 10, 11, 12, 13, 14 and 15, thereby forming an endless or continuous web. Roller 10 is coupled to a drive motor M in a conventional manner. Motor M is connected to a source of potential V when a switch SW is closed by a logic and control unit (LCU) 31. When the switch SW is closed, the roller 10 is driven by the motor M and moves the web 5 in clockwise direction as indicated by arrow A. This movement causes successive image areas of web 5 to sequentially pass a series of work stations of the apparatus 1. These workstations include: a charging station 17,17*a* at which the photoconductive surface 9 of the web 5 is sensitized by applying to such surface a uniform electrostatic charge of a predetermined voltage; an exposure station 18 at which a light image of a document sheet S, supported on transparent platen 2, is projected by mirrors 6, 8 and lens 7 onto the photoconductive surface 9 of the web 5 to produce a latent electrostatic image of the document sheet. Also included are a magnetic brush development station 19 at which the latent image is developed with developer which may consist of iron carrier particles and electroscopic toner particles with an electrostatic charge opposite to that of the latent electrostatic image, to form a toner image on web 5. A transfer station, including a corona charger 21 transfers the toner image on web 5 to a copy sheet S' which is transported to a heated pressure roller fuser 27 where the toner image is fixed to copy sheet S'. The sheet S' containing a fixed toner image is fed to a finisher/sorter or a top exit tray.

A cleaning station 25 is provided to clean the photoconductive surface 9 of web 5 of any residual toner particles remaining after the toner images have been transferred.

Copy sheet S' is fed from one of supplies 23*a* or 23*b* to continuously driven rollers 20 which urge sheet S' against a rotating registration finger 29 of a copy sheet registration mechanism 22, from which it is fed to the transfer station 21.

Apparatus 1 includes an additional color development station 19*a*, a duplex tray DT and a digitizer, including digitizer tablet 52, wand 54 and circuit 56 which provide digital signals to LCU 31.

Figure 3:
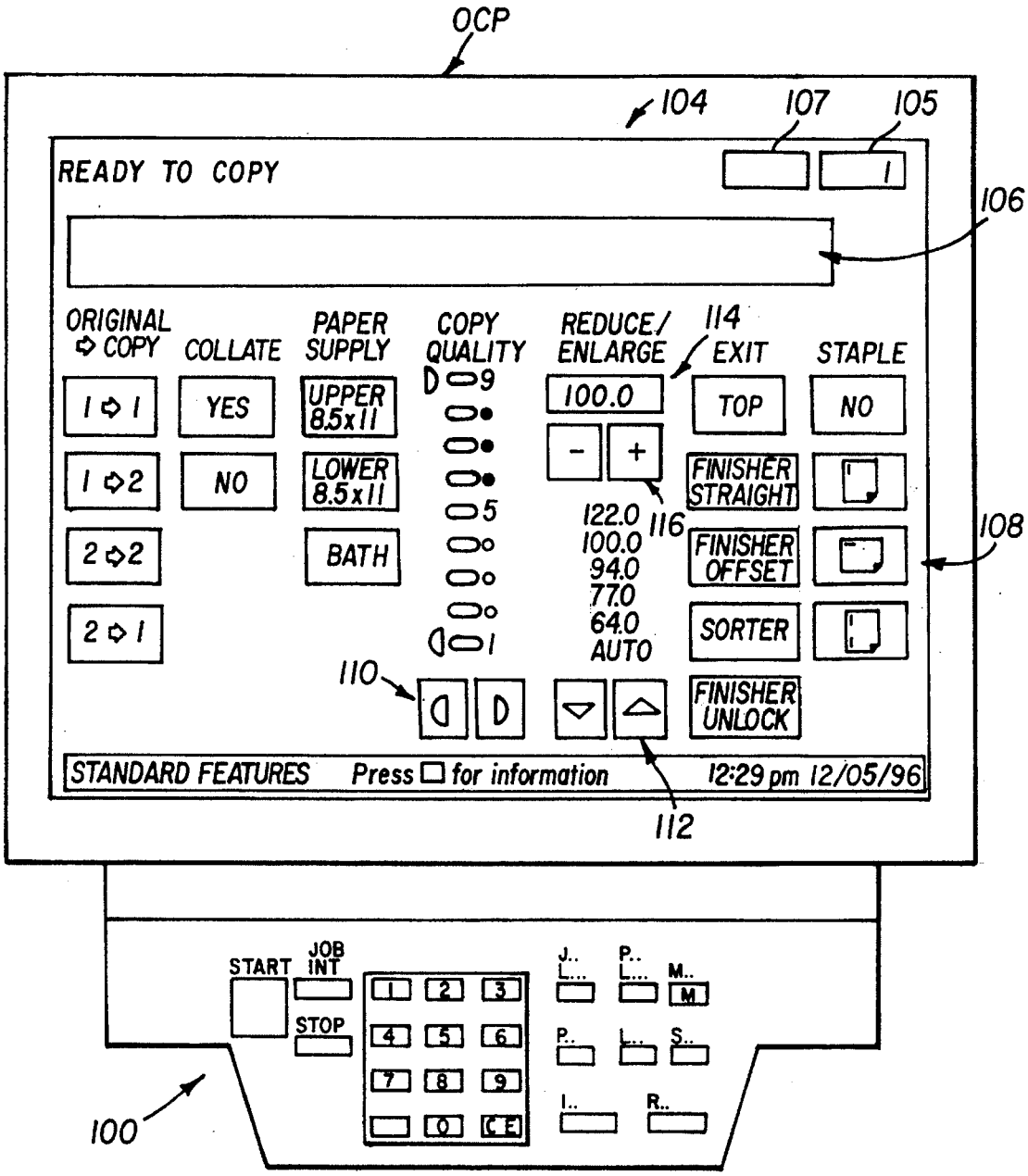
FIG. 3 is a diagrammatic view of an operator control panel, including a display with a touchscreen.

Referring now to FIG. 3, there is shown an operator control panel (OCP) which includes a set 100 of dedicated "hard" buttons or keys and a touchscreen display 104 to allow operator input and control of apparatus 1. The touchscreen display 104 includes (1) a known programmable type display wherein LCU 31 includes a computer program and a bit map memory for controlling the representation that is visible on the display and (2) a touchscreen which overlays the display. The touchscreen is an operator input device having operator actuable "soft" buttons and areas for providing operator input to the reproduction apparatus. Touchscreens are well known and include resistive, acoustic, and infrared type input technologies.

The operator selectable set of hard buttons on the left include, START, JOB INTERRUPT, and STOP buttons. In the middle are numerical buttons 0–9 to set the number of copies or sets to be copied. A * and CE (clear entry) buttons are also included. On the right are the following hard buttons; JOB LEVEL, PAGE LEVEL, MEMORY, PROOF, LANGUAGE, SUMMARY, INFORMATION and RESET. The INFORMATION (i) button accesses an information system (stored in memory in LCU 31) which provides detailed information about reproduction apparatus 1 including features selectable by the operator and messages which are displayed on touchscreen display 104.

As shown in FIG. 3, the screen illustrated on the touchscreen display is referred to as the "standard features" screen as it displays various features that a casual user of the apparatus 1 would want when first approaching the apparatus for an average reproduction run. The screen includes a message display area 106, a copies or sets requested display area 105, a copies or sets completed display area 107, and a "soft" button area 108. The "soft" button area includes selectable features with plural displayed options for each feature. The features shown are original copy, collate, paper supply, copy quality, reduce/enlarge, exit, staple. The plural selected options for each feature are provided with operator actuable soft buttons overlaying the displayed feature options. The selected feature option is highlighted.

The copy quality and reduce/enlarge features are provided with respective scroll buttons 110,112 for scrolling through the feature options. The feature options are sequentially highlighted during scrolling. The reduce/enlarge feature also includes a zoom option 114 with scroll buttons 116.

Certain feature options may also be locked out to the operator, although displayed. Such feature option (e.g., the "finisher unlock" option under the "exit" feature shown in FIG. 3) is highlighted in a different manner than highlighted feature options.

Figure 4:
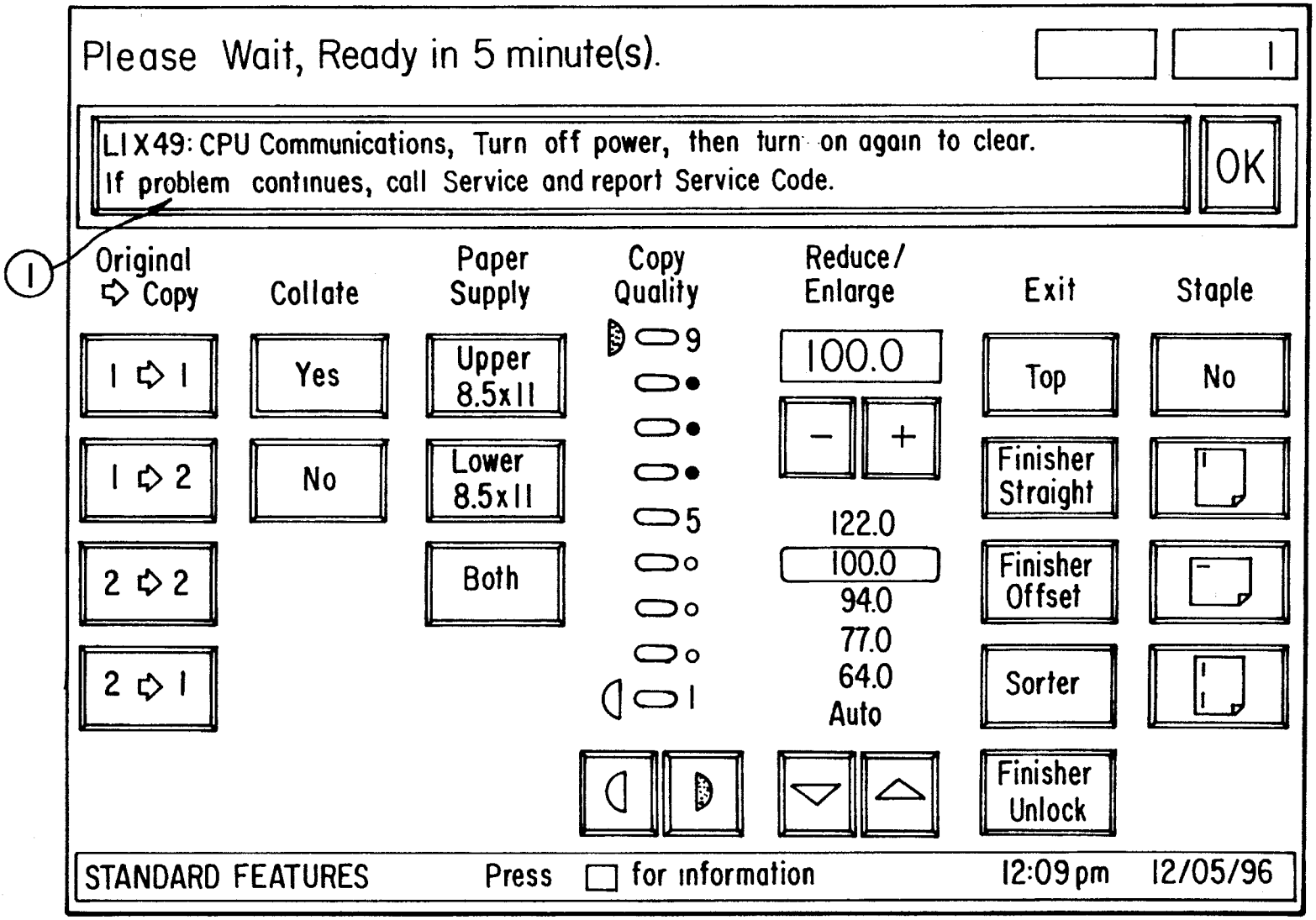
FIGS. 4–9 are respective screens useful in explaining the present invention.
Figure 5:
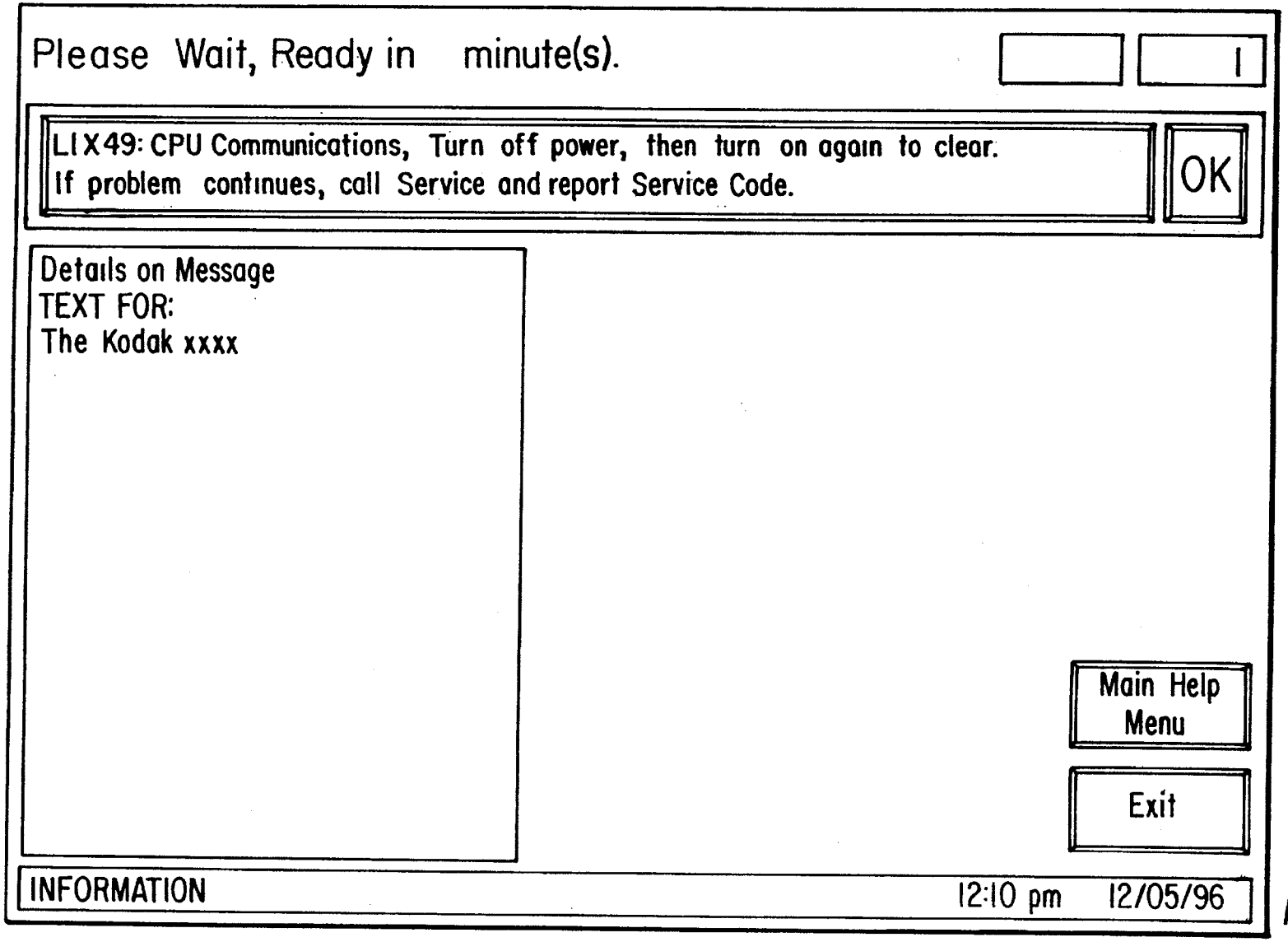

According to the invention, multiple ways are provided for entering the information system of the reproduction apparatus 1. As with conventional reproduction apparatus, the information system can be entered by operator actuation of the information "i" hard button on the left side of the operator control panel. According to one feature of the invention, the information system also can be entered by touching the message area 106 of the touchscreen display 104 when a message is displayed (FIG. 4). The information system will be activated to display information about the current message(s) displayed in the message area (FIG. 5). The operator can also navigate to other locations in the information system.

Figure 6:
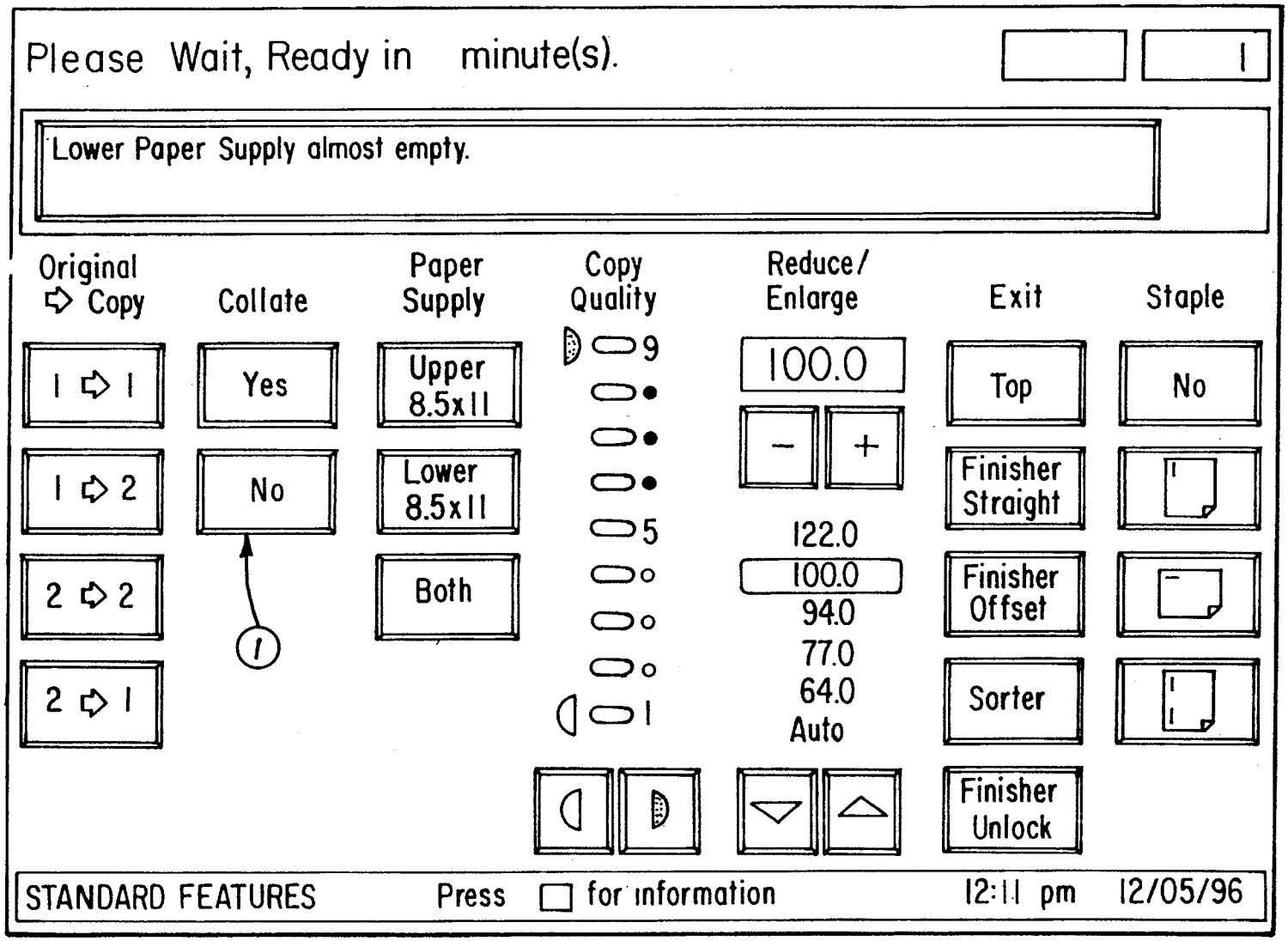
Figure 7:
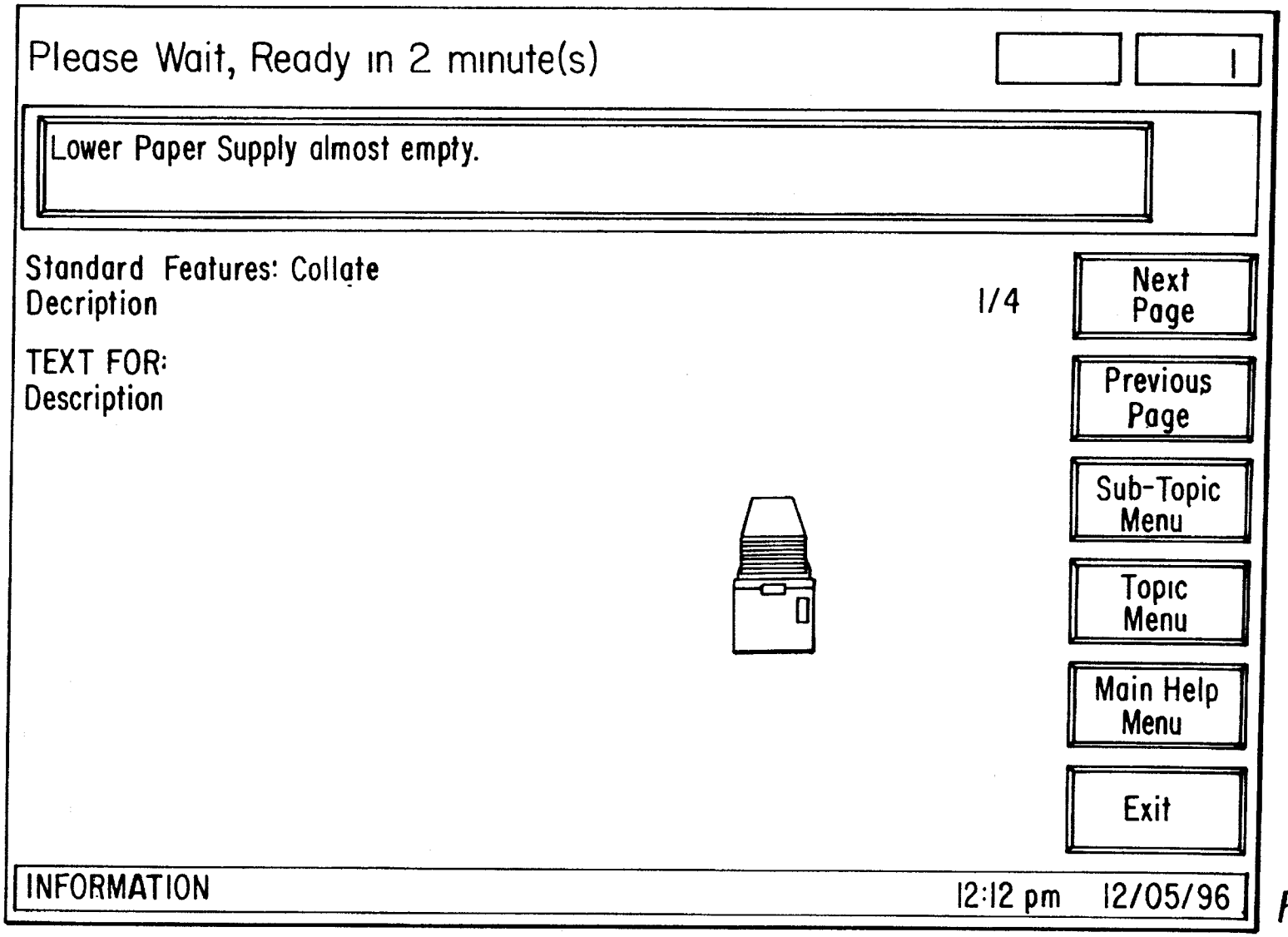

According to another feature of the present invention, touching a "locked out" feature option will enter the information system. (A locked out feature is one that cannot be selected because is conflicts with another selected feature). As shown in FIG. 6, the "No" option under the "Collate" feature is displayed as locked out. By touching the "locked out" feature area (① arrow), the operator activates the information system. Information will be displayed in a subsequent screen (FIG. 7) explaining why the particular feature is locked out. The operator can also navigate to other locations in the information system.

Figure 8:
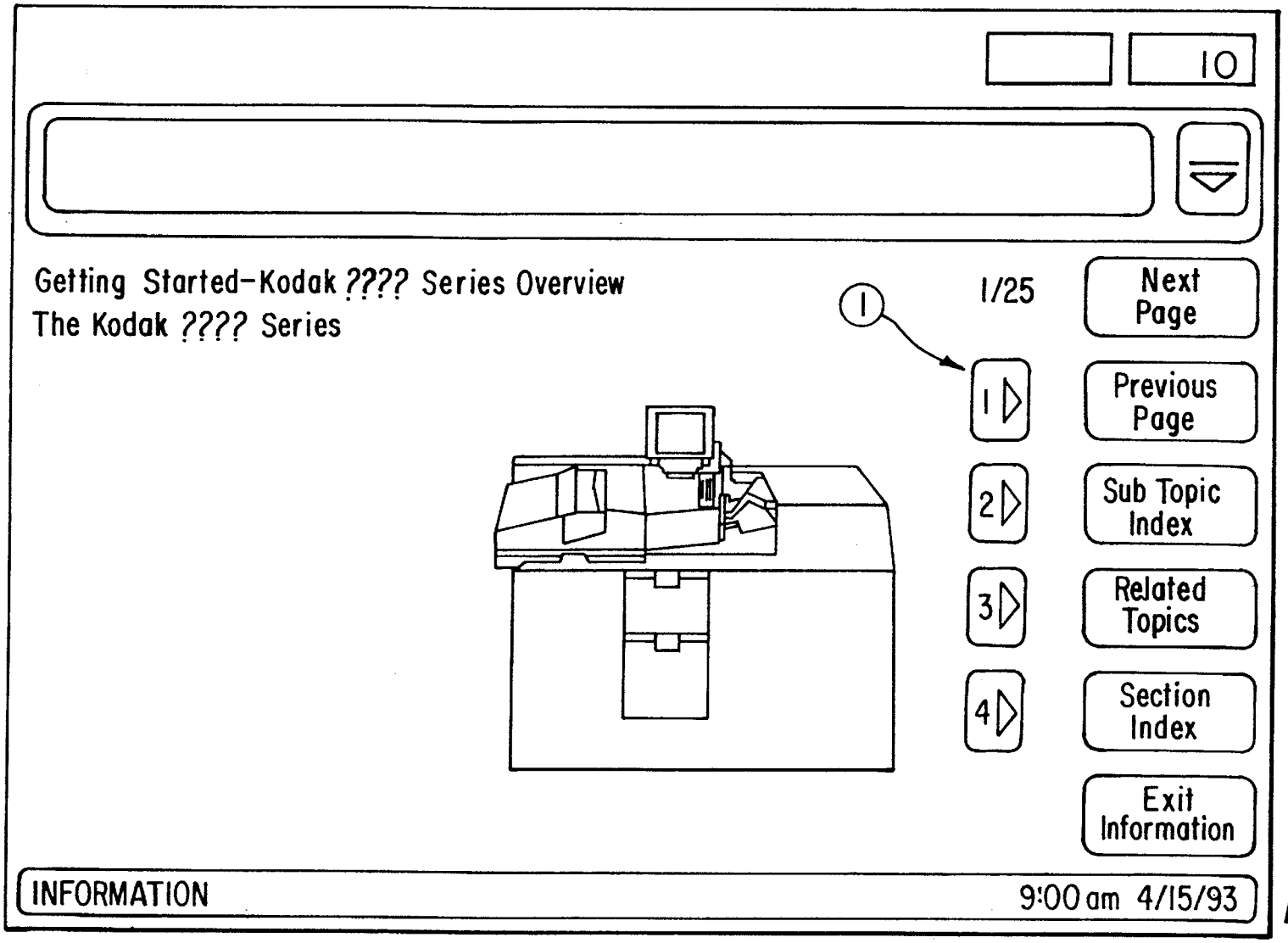
Figure 9:
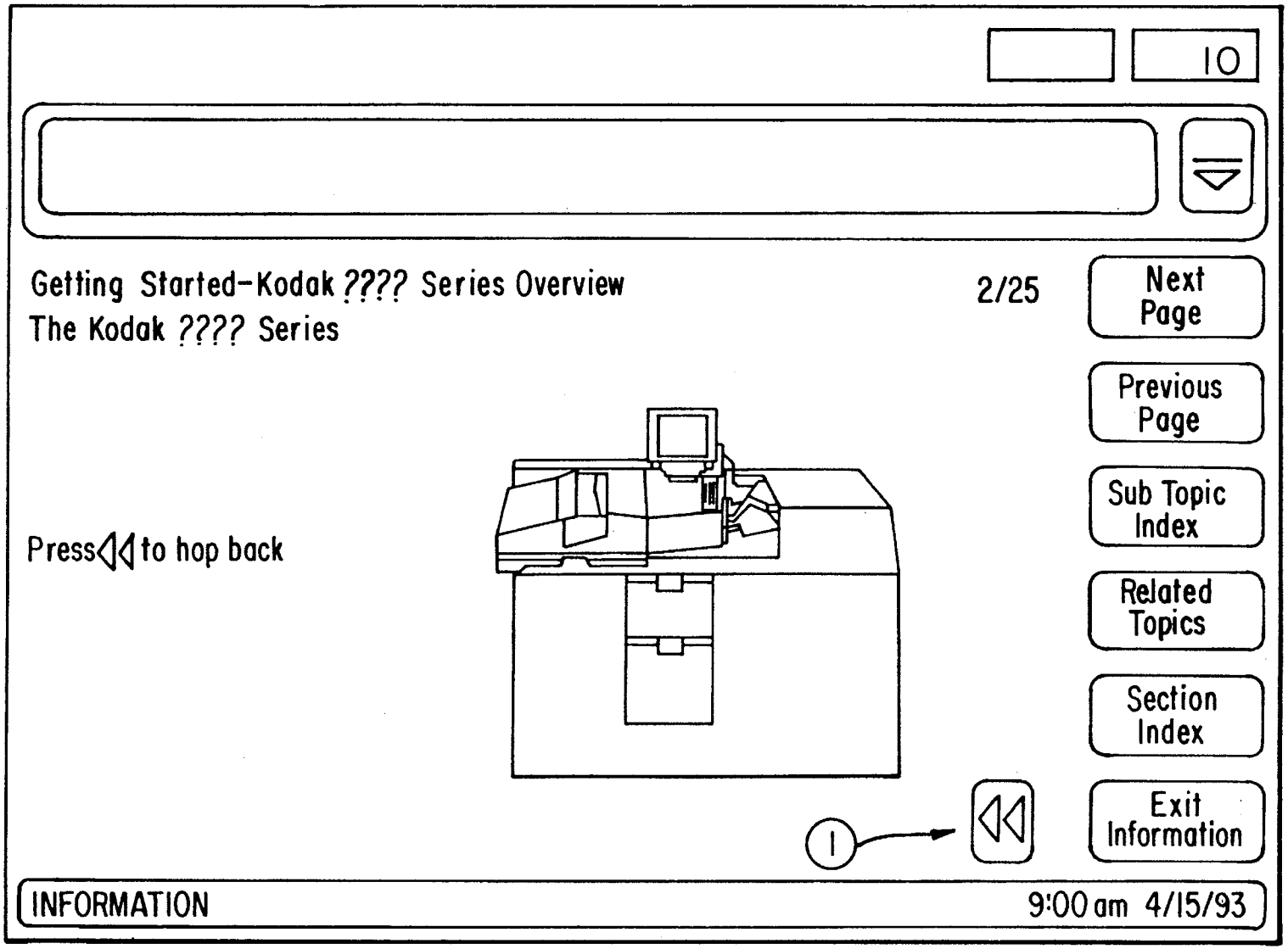

According to still another feature of the present invention, once inside the information system, key words and phrases will be highlighted to enable the operator to jump quickly to information on these topics in other areas of the information system. This, "quick jump" capability eliminates the need to navigate through traditional menus in the information system to access other topics. As shown in FIG. 8, the information system has been activated and the touchscreen display shows, for example, a graphical illustration of an electrographic reproduction apparatus. To the right of the graphical illustration are four "quick jump" soft buttons, while to the left is denoted an area labeled "information", which includes information explaining where in the information system actuation of one of the "quick jump" soft buttons 1–4 will cause passage. By touching a "quick jump" area (as illustrated by the arrow from ① in FIG. 8), the information system jumps to the requested information section, as illustrated by the screen shown in FIG. 9. If the operator touches the "Hop Back" area in FIG. 9, the information system returns to the original location in the information system, i.e., to the screen shown in FIG. 8.

The invention has been described in detail herein with reference to the figures, however, it will be appreciated that variations and modifications are possible within the spirit and scope of the invention.

What is claimed is:

1. In reproduction apparatus having a plurality of selectable features for carrying out a reproduction run, an operator control panel for controlling said reproduction apparatus comprising:

a plurality of operator selectable "hard" buttons for providing input to and control of said reproduction apparatus;

a display for displaying selectable features for a reproduction run and for displaying messages;

a touchscreen overlaying at least a part of said display, having operator selectable "soft" buttons and areas for providing operator input to said reproduction apparatus; and an information system stored in said reproduction apparatus, said information system being accessible either by one of said plurality of operator selectable hard buttons or by an operator selectable soft button or area of said touchscreen;

wherein said touchscreen displays a plurality of soft buttons for controlling features of said reproduction apparatus, wherein at least one of said features is locked out to the operator, and wherein operator touching of said locked out soft button accesses the information system and displays information about the feature which is locked out.

2. The operator control panel of claim 1 wherein said touchscreen displays a message area and a plurality of "soft" buttons for operator input, and wherein operator actuation of the message area accesses the information system and displays information about the current message in the message area.

3. The operator control panel of claim 1 wherein said touchscreen displays an information screen and one or more "quick jump" soft buttons which, when actuated, displays a second information screen having a "hop back" soft button, actuation of which returns to the original information screen.

* * * * *